United States Patent [19]

Hodde et al.

[11] 4,168,815

[45] Sep. 25, 1979

[54] KITE LAUNCHING AND STABILIZING APPARATUS

[76] Inventors: Raymond L. Hodde, R.R. 2, Hamburg, Iowa 51640; Paul M. Nash, 1825 - 64th St., Des Moines, Iowa 50322

[21] Appl. No.: 844,532

[22] Filed: Oct. 25, 1977

[51] Int. Cl.[2] ..... B64C 31/06

[52] U.S. Cl. ..... 244/155 R; 124/79; 244/63

[58] Field of Search ..... 244/155 R, 153 R, 154, 244/63, 155 A; 46/74 B, 81, 86 R; 124/79, 17

[56] References Cited

U.S. PATENT DOCUMENTS

| | | | |
|---|---|---|---|
| 96,550 | 11/1869 | Clark | 244/153 R |
| 1,572,270 | 2/1926 | Dwyer | 46/81 |
| 3,758,057 | 9/1973 | Stratton | 244/154 |

OTHER PUBLICATIONS

Pelham, *Kites,* Penguin Books, 1976, pp. 122–123.

*Primary Examiner*—Barry L. Kelmachter
*Attorney, Agent, or Firm*—Henderson & Sturm

[57] ABSTRACT

Kite launching apparatus including a control line with a portion thereof which is elastic. A portion of a Velcro holding structure is operatively attached to the kite or the control line. A stake is provided for being anchored to the ground. Another portion of the Velcro holding structure is operatively attached to the stake whereby the two portions of Velcro can be connected together. Once the Velcro holding structure portions are connected together the launching structure can be utilized by pulling on the control line to stretch the elastic portion thereof. When enough force has been applied to the Velcro holding structure to cause the two Velcro portions to come apart, the kite is automatically launched because of the pull of the elastic portion of the control line as it returns to its original shape.

15 Claims, 5 Drawing Figures

KITE LAUNCHING AND STABILIZING APPARATUS

BACKGROUND OF THE INVENTION

The pastime of flying kites has apparently been practiced for centuries. While the structures of such kites have developed to the extent that there are hundreds of popular types of kites, the methods of flying such kites have essentially remained the same. The primary method of launching a kite is to have one person holding the kite while another person holds on to the control line or string. With a strong wind blowing, the person holding the kite would merely guide it straight upwardly while the person on the control string would pull to keep the string tight as the kite proceeds upwardly into the wind. If there is insufficient wind for such procedure, then the person on the control string would run with the string and the person holding the kite would guidingly release it, and perhaps even run with the kite in the general direction and at the same general speed as the person on the control string before releasing it.

It has proven to be exceedingly difficult, if not impossible at times, to launch a kite single handedly; that is, without someone to guide and hold the kite. Consequently, there is a need for structures which will readily facilitate the launching of a kite by only one person.

Another traditional problem with kites has been that they sometimes tend to take nose dives to the ground or towards the ground due to abrupt changes in atmospheric air currents. Various stabilizers such as long tails have been used to prevent such events. U.S. Pat. No. 2,451,571 to Marshall also shows a dive stabilizer mechanism. But most structures devised to stabilize kites have been unduly cumbersome and complicated or too expensive to competitively produce. Consequently, there is obviously a need for an effective, simple and economical solution to this problem.

SUMMARY OF THE INVENTION

Apparatus for launching a kite with a control line attached thereto to be held by the person using such kite. At least a portion of such control line is constructed of elastic material for stabilizing the flight of the kite and aiding in the launch of such kite. A holding device is provided for releasably holding the kite in a position to be launched and an anchor structure is provided for selectively retaining the holding device with respect to the ground.

An object of the invention is to provide an improvement for kites.

Another object of the invention is to provide a kite launching apparatus for allowing one person to launch and fly a kite without the aid of other people.

A further object of the invention is to provide a kite launching apparatus which is adaptable for use with any kite.

Still another object is to provide an apparatus for facilitating the launching of a kite even in the absence of wind currents.

A still further object of the invention is to provide a dive stabilizer for a kite.

Other objects, advantages and novel features of the present invention will become apparent from the following detailed description of the invention when considered in conjunction with the accompanying drawings.

DESCRIPTION OF THE PREFERRED EMBODIMENTS

Figure 1:
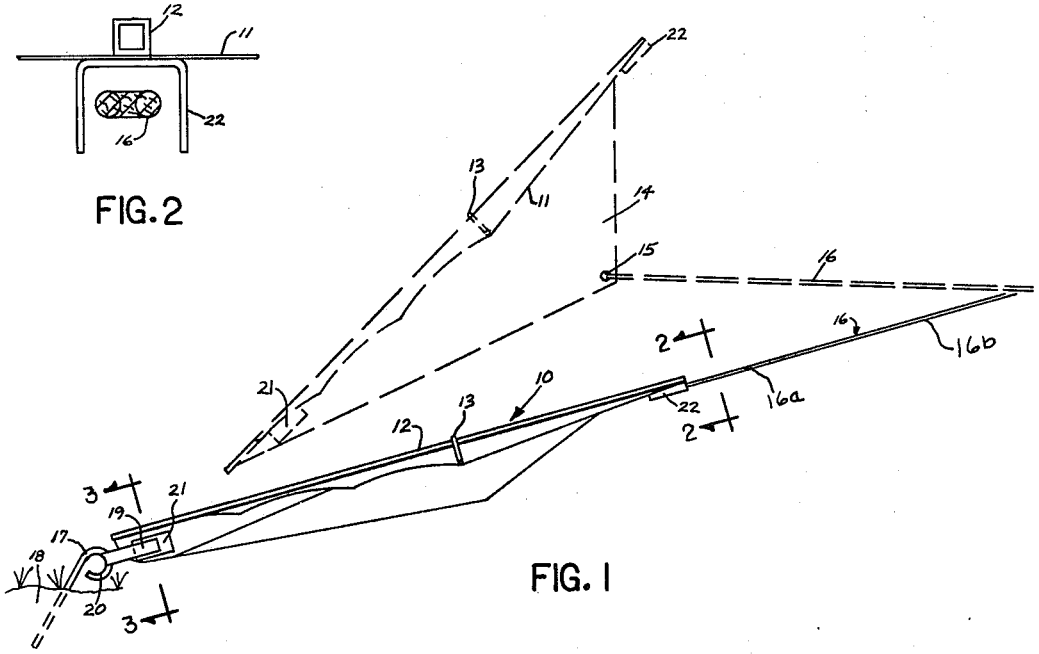
FIG. 1 is a side elevational view of a preferred embodiment of the invention showing a kite in solid lines in readiness to be launched and in dashed lines during the initial stages of launching.

Referring now to the drawings wherein like reference numerals designate identical or corresponding parts throughout the several views, FIG. 1 shows a kite 10 constructed in accordance with the present invention. The kite 10 is basically of conventional construction with a few additional parts. For example, a flat portion 11 is braced in a longitudinal direction by a brace 12 (FIG. 2) and in a lateral direction by a brace 13. The portion 11 is usually made of plastic and the portions 12 and 13 normally of wood, but the particular material of construction is not critical.

This particular type of kite 10 is normally referred to as a keel-type of kite because of a forwardly extending flap member 14 which is referred to as a keel or connection structure. The keel 14 has a reinforced opening or junction point 15 therein for reception of a control line 16. This control line 16 is tied to the keel 14 normally in a knot. The portion **16*a* of the control line which is shown in FIG. 1 is preferably made of an elastic material. This elastic material can be from a few inches in length to 20 or more feet. The other end 16*b* of the control line 16, that is on the opposite end from the opening 15 would be a conventional kite string. Alternatively, the entire control line 16** can be made of string or other nonresilient material, but it looses some of the advantages which will be referred to below.

It is also worthwhile to mention that the type of resilient or elastic material of the control line 16 is not critical and it could, for example, be rubber or a type of elastic material used for making clothing.

Referring now still more specifically to FIG. 1, it is noted that an anchor stake 17 has been driven into the ground 18 and that a first Velcro strip 19 is attached thereto such as by sewing it into a loop and slipping it onto the loop 20 of the stake 17. A complementary piece of Velcro material 21 is secured to the keel 14 of the kite 10 at the rear thereof as shown in FIG. 1. The material 21 can be secured by glue or any other suitable means.

Figure 2:
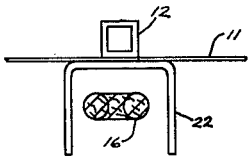
FIG. 2 is a cross-sectional view taken along line 2—2 of FIG. 1.

A U-shaped guide structure 22 is also secured to the front and center of the kite 10 as is shown in detail in FIGS. 1 and 2. It is not critical with regard to how this U-shaped guide member 22 is secured to the kite and it can be accomplished by gluing it there, for example.

Figure 3:
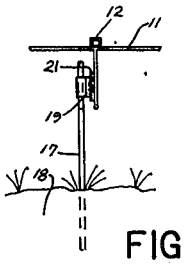
FIG. 3 is a cross-sectional view taken along line 3—3 of FIG. 1.

In order to utilize the embodiment shown in FIGS. 1–3, the stake 17 with the Velcro piece 19 attached thereto is first driven into the ground 18. It is to be understood that any other anchoring means, such as a weighted object or a belt on a fence post or the like, could be used instead of a stake. In any event, the kite 10 is grasped and placed so that the Velcro portion 21 on the keel 14 of the kite 10 is pressed against the Velcro 19 of the stake, for example as shown in FIG. 1. Once this has been done, then the control line 16 is grasped and guided into the guiding structure 22, for example as shown in FIGS. 1 and 2. At that point in time the person utilizing this launching apparatus would continue to keep the tension on the line 16 and he would gradually back away from the kite 10, for example directly to the right as shown in FIG. 1, sliding his hand down the control line 16 so as to always keep pressure on the control line 16 as he so moves. Once he is a sufficient distance away, for example 50 feet, he would then pull on the control line 16 until the elastic portion has stretched to a maximum amount. Continued pulling on the control line 16 will eventually exceed the force required to break the connection between the Velcro pieces 19 and 21. Once this occurs, the tension on the control line 16 will cause the kite to immediately launch upwardly into the air, for example as shown in the initial stage of such launching in dashed lines in FIG. 1.

While this invention will work when the control line 16 is constructed of a non-resilient type of material such as ordinary kite string, it performs much better if the elastic portion referred to above is utilized. Consequently, if the elastic is used, once the Velcro pieces 19 and 21 separate, the elastic will give a very strong pull on the kite 10 and will significantly aid in the launching of the kite. If there is enough wind, the lauching of the kite is made easier by launching it into the wind, but it is to be understood that a kite can be launched utilizing this invention without any wind at all; but, under such conditions it would require that the person flying the kite run while holding onto the control line 16 once it is launched in order to keep it flying.

Once the kite is up in the air, the presence of an elastic portion on the control line 16 will act as a dive stabilizer. That is, this elastic portion will prevent the kite from taking dives because it cushions abrupt wind changes, something that does not occur when a non-resilient control line is used.

Figure 4:
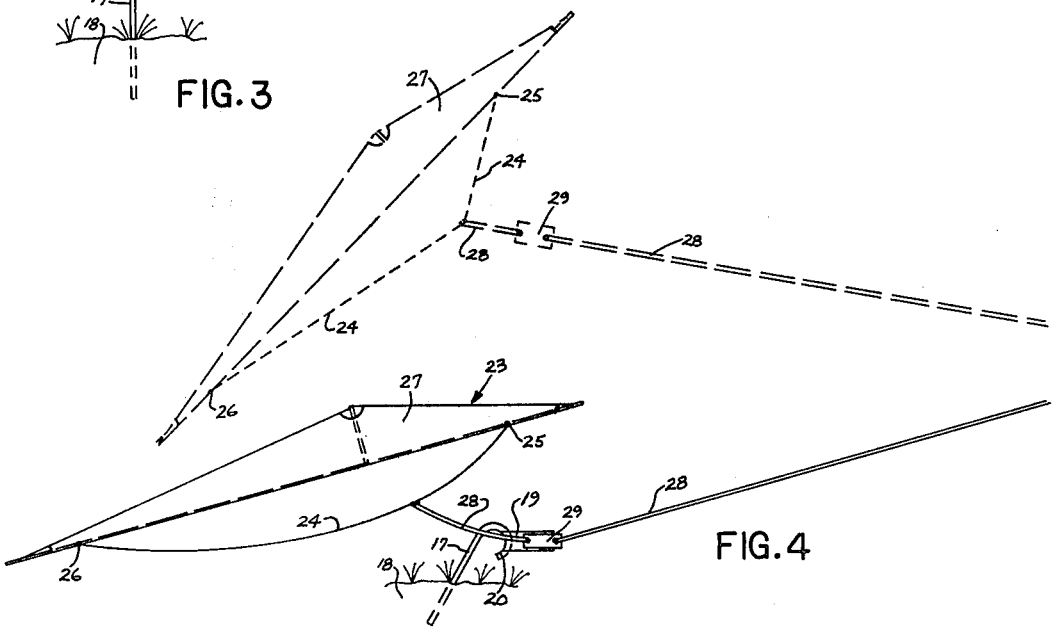
FIG. 4 is a side elevational view of a second preferred embodiment of the present invention and showing a kite in readiness to be launched in solid lines and a kite being launched during the initial stages of such launching in dashed lines.

Referring now to FIG. 4, a second embodiment is shown and illustrates what shall be termed a front mount model. A kite 23 is shown; and, this kite 23 can be referred to as a modified diamond-shaped kite since it resembles a diamond, but it is longer at the bottom rather than being completely symmetrical. This kite 23 would, of course, have conventional perpendicular bracing from corner to corner, but such bracing is not shown in detail. A string or connection structure 24 extends from one point 25 attached to the longitudinal brace, to another point 26 wherein it is tied to the longitudinal brace. A material such as paper or plastic 27 serves as the means for catching the wind.

Figure 5:
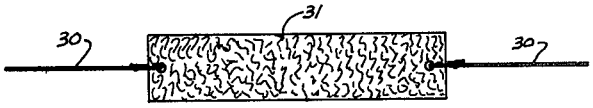
FIG. 5 shows one way in which Velcro can be attached to a control line or string for use in a front mount kite launching apparatus, for example as shown in FIG. 4.

The same type of anchor 17 is shown in FIG. 4 as is shown in FIG. 1, and it also has a Velcro strip 19 attached thereto as in the FIG. 1 embodiment. The FIG. 4 embodiment, instead of having the Velcro attached directly to the kite as in the FIG. 1 embodiment, has the Velcro attached to the control line 28 near where the control line 28 contacts and attaches to the string 24 at junction point 33. This Velcro strip 29 can be attached to the control line 28 in any of several different ways such as by being tied thereto or being sewn thereto. In the embodiment shown in FIG. 4, the control line 28 is again made of an elastic material, but it could instead be made of string 30 for example as shown in FIG. 5 and having a Velcro strip 31.

The launching procedure for the FIG. 4 embodiment is exactly like that of the FIG. 1 embodiment once the Velcro 29 is attached to the Velcro 19.

It is very clear that the two embodiments shown do indeed accomplish the objects referred to above. It should also be quite apparent that this invention is adaptable to all kinds of kites or other objects or projectiles which are launched in a similar fashion. For example, box kites, square kites, inflated kites and kites of the shape of fish and animals can all be launched by one person by utilizing the principles of this invention.

Also, with respect to the releasable holding device, it is noted that while a preferred embodiment using Velcro is disclosed, that other releasable holding devices would be included in this invention in its broadest sense. For example, a clothes pin of the type being spring biased to a closed position attached to an anchor stake could serve as a releasable holding device for such a kite launcher of the type disclosed herein. Obviously many modifications and variations of the present invention are possible in light of the above teachings. It is therefore to be understood that, within the scope of the appended claims, the invention may be practiced otherwise than as specifically described.

We claim:

1. Apparatus for launching a kite of a type including a control line attached thereto comprising:

holding means for releasably holding the kite in a position to be launched, said holding means being for selectively preventing said kite from being pulled from an anchor means in response to a pulling force on said control line and for automatically releasing the kite for launch when the pulling force on said control line is increased sufficiently; and said anchor means selectively retaining said holding means with respect to the ground.

2. Apparatus as defined in claim 1 wherein said holding means comprises a first Velcro material operatively attached to said kite and a second complementary Velcro material operatively attached to said anchor means and selectively engageable with said first Velcro material.

3. Apparatus as defined in claim 1 wherein said anchor means comprises a stake driven into the ground.

4. Apparatus as defined in claim 1 wherein said holding means comprises Velcro material operatively attached to said control line and a complementary Velcro material operatively attached to said anchor means.

5. Apparatus as defined in claim 4 wherein said anchor means comprises a stake disposed in the ground.

6. Apparatus as defined in claim 1 wherein a portion of said control line is constructed of an elastic material.

7. Apparatus as defined in claim 6 wherein said holding means comprises Velcro material attached to said elastic portion and a complementary Velcro material operatively attached to said anchor means.

8. Apparatus as defined in claim 1 wherein said control line includes elastic means for stretching as said pulling force increases and tending to quickly return to its original shape when said holding means releases thereby aiding in the launch of the kite.

9. Apparatus in claim 1 wherein said holding means comprises a first Velcro material attached to the rear of said kite and a second complementary Velcro material operatively attached to said anchor means and selectively engageable with said first Velcro material; and, guide means attached to the front of said kite for receiving a portion of said control line and causing the kite to be in alignment with said control line during launch.

10. Apparatus as defined in claim 9 wherein said guide means is substantially U-shaped in cross section.

11. Apparatus comprising:

a kite;

a control line attached at one end thereof to said kite, at least a portion of said control line being constructed of elastic material;

holding means for releasably holding the kite in preparation for launching of the kite, said holding means being for selectively preventing said kite from being pulled from an anchor means in response to a pulling force on said control line and for automatically releasing the kite for launch when the pulling force on said control line is increased sufficiently; and said anchor means selectively retaining said holding means with respect to the ground.

12. Apparatus as defined in claim 11 wherein said holding means comprises a first Velcro material operatively attached to said kite and a second complementary Velcro material operatively attached to said anchor means and selectively engageable with said first Velcro material.

13. Apparatus as defined in claim 11 wherein said anchor means comprises a stake driven into the ground.

14. Apparatus as defined in claim 11 wherein said holding means comprises Velcro material operatively attached to said control line and a complementary Velcro material operatively attached to said anchor means.

15. Apparatus as defined in claim 14 wherein said anchor means comprises a stake disposed in the ground.

* * * * *